US005469721A

United States Patent [19]

Pyle

[11] Patent Number: 5,469,721

[45] Date of Patent: Nov. 28, 1995

[54] BOAT PROPELLER CASE AND LOCK

[76] Inventor: Stephen K. Pyle, 3026 Dixie Hwy., Waterford, Mich. 48328

[21] Appl. No.: 217,558

[22] Filed: Mar. 25, 1994

[51] Int. Cl.[6] ..... B63H 5/16

[52] U.S. Cl. ..... 70/14; 70/58; 70/164; 70/232; 70/DIG. 49; 114/221 R; 416/247 A

[58] Field of Search ..... 70/232, DIG. 49, 70/57, 58, 14, 177–180, 158, 159, 163, 164, 166–173; 416/247 R, 247 A, 246, 244 B, 245 A, 146 B; 114/221 R

[56] References Cited

U.S. PATENT DOCUMENTS

| | | | |
|---|---|---|---|
| 1,713,446 | 5/1929 | Peterson | 416/247 A |
| 2,362,323 | 11/1944 | Stoppel | 416/247 A |
| 2,706,960 | 4/1955 | Crew | 416/247 X |
| 2,822,183 | 2/1958 | Montgomery | 416/247 A X |
| 3,981,165 | 9/1976 | Wersinger | 70/232 |
| 4,502,306 | 3/1985 | Scammacca | 70/232 X |
| 4,577,458 | 12/1985 | Vahlberg et al. | 70/58 X |
| 4,957,459 | 9/1990 | Snyder | 416/247 A X |
| 4,959,981 | 10/1990 | Davidson | 70/238 |
| 5,066,254 | 11/1991 | Bass et al. | 416/247 A X |
| 5,172,097 | 12/1992 | Arnold | 70/DIG. 49 X |
| 5,176,550 | 1/1993 | Hooper | 416/247 A X |
| 5,184,488 | 2/1993 | Sandlin | 70/232 X |
| 5,246,345 | 9/1993 | Adams, Jr. | 70/232 X |

*Primary Examiner*—Lloyd A. Gall
*Attorney, Agent, or Firm*—Alex Rhodes

[57] ABSTRACT

A case and lock for reducing damage and deterring theft of boat propellers. The invention is comprised of a case for enclosing a boat propeller and a portion of a propeller drive unit. The case has a pair of pivotally connected members which are supported by a horizontal stabilizer fin of a propeller drive unit. The lock lockably connects the case members. One optional feature of the invention are running lights mounted on the sides of the lockable case members. Another optional feature is an electronic alarm which is activated during attempts to steal the propeller.

10 Claims, 3 Drawing Sheets

BOAT PROPELLER CASE AND LOCK

FIELD OF THE INVENTION

This invention relates to engine security devices and more particularly to a case for reducing damage and deterring theft of boat propellers.

BACKGROUND OF THE INVENTION

Damage and theft are common problems with boat propellers. Damage may occur during boat transport, boat storage or impact with submerged objects, lake or river bottoms. Impacts result in damaged propeller blades and out-of-balance conditions. Corrosion occurs during outdoor storage as well as submersion in water.

Replacement propellers are high in cost because of their complex shapes, precision balance and corrosion resistance requirements. Precision balance requires expensive machining. Corrosion resistance requires expensive materials and coatings.

Theft is a major problem because of the high costs of replacement propellers and the ease of propeller removal. It is not unusual for a replacement propeller to cost several hundred dollars. Propellers are attached with standard nuts making them easily removable with common tools. The high costs and ease of removal make them attractive to thieves.

Anti-theft devices for boat propellers are known in the art. One disadvantage of known devices is that they are not applicable to existing engines. Macchi U.S. Pat. No. 3,732,033; Reese U.S. Pat. No. 3,759,076; and Sims U.S. Pat. No. 4,257,247 are exemplary of the prior art. Macchi discloses a lockable cover for enclosing a nut which retains a propeller. Reese discloses a locking bar for locking a propeller to a hub. Sims discloses a cage-like structure, chain and pad lock for preventing removal of a castellated nut which retains a boat propeller. All of the above require engine modifications.

SUMMARY OF THE INVENTION

The present invention is a case and lock for reducing damage and deterring theft of boat propellers. The case is adapted to enclose a boat propeller and a portion of a propeller drive unit, including a horizontal stabilizer fin and vertical rudder.

The case is comprised of a pair of pivotally connected half portions. The lock lockably conneets opposite end portions of the case.

One optional feature of the invention are running lights which are mounted on the sides of the case members for reducing the occurrence of impacts by other vehicles.

Another optional feature is an electronic alarm which is activated during attempts to steal the propeller.

Other benefits, features, and objects of the invention will become apparent from the ensuing detailed description and accompanying drawings. The best mode contemplated by the inventor is disclosed and the property in which exclusive rights are claimed is set forth in each of the numbered claims which are appended to the detailed description of the invention.

DETAILED DESCRIPTION OF THE PREFERRED EMBODIMENT

Figure 2:
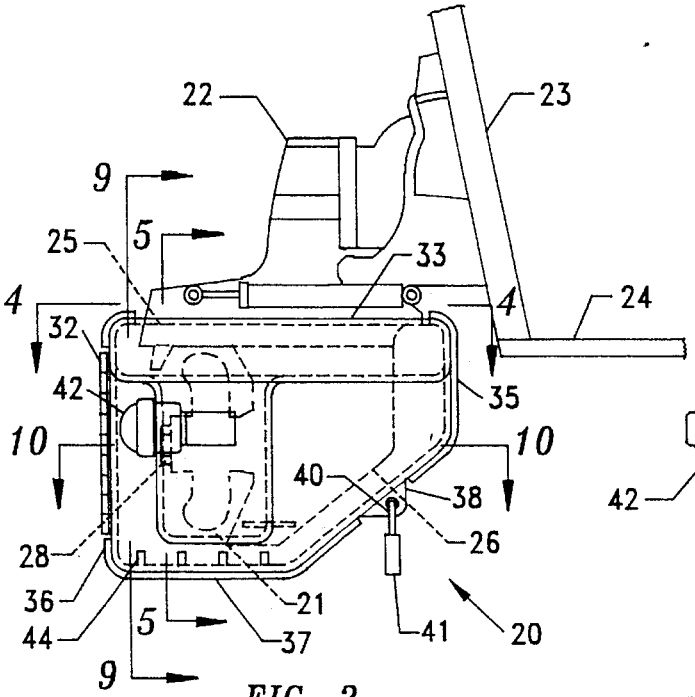
FIG. 2 is a side view of the propeller guard and lock mounted on the propeller of a propeller drive unit.

Referring now to the drawings, wherein like numerals designate like and corresponding parts, in FIGS. 1 through 11, inclusive, a case 29 and lock 41 is shown mounted on a propeller 21 and drive unit 22 according to the present invention 20.

The case 29 completely encloses the propeller 21 and a portion of the propeller drive unit 22. The propeller 21 and propeller drive unit 22 are conventional and extend rearwardly from a transom 23 of a boat 24. The drive unit 22 is connected to an engine (not shown) which is inside the boat 24. The drive unit 22 includes a horizontal stabilizer fin 25 and vertical rudder 26 below the stabilizer fin 25. The propeller 21 is secured to the drive unit 22 with a conventional nut 28. The propeller 21 can be quickly removed by disengaging the nut 28 with a conventional tool.

Although the invention 20 is illustrated in combination with an inboard/outboard type powerplant, it is not my intention to limit the invention in this manner, since my invention is applicable to a variety of powerplants, including conventional inboard and outboard boat engines.

Figure 7:
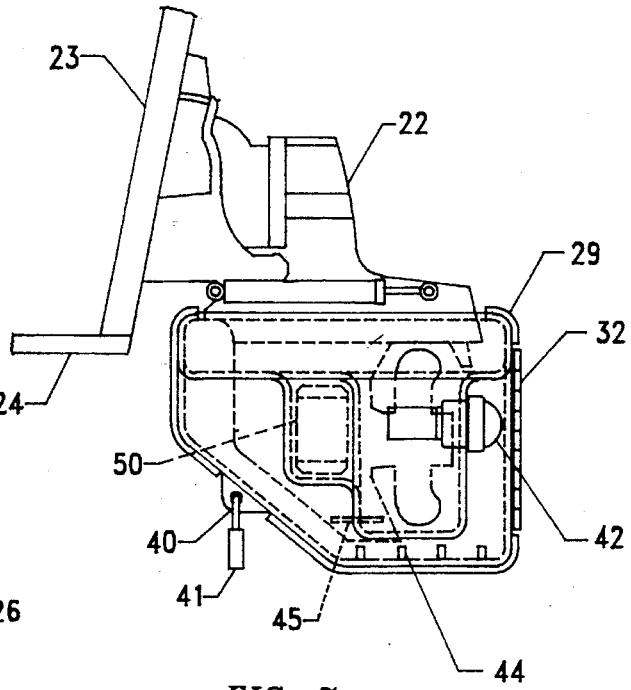
FIG. 7 is a right side view of the propeller guard and lock and propeller drive unit.
Figure 11:
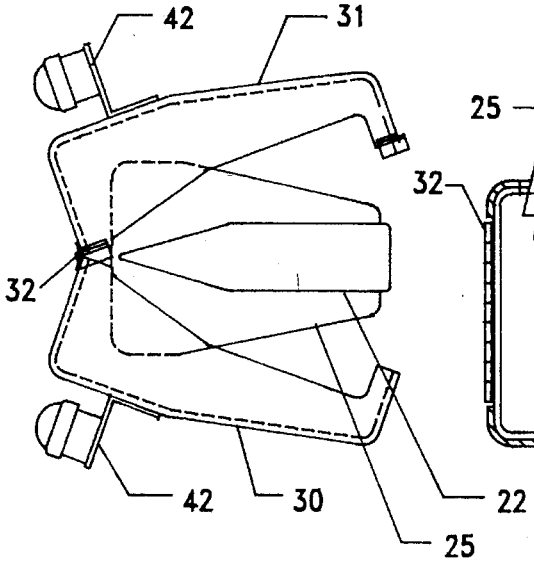
FIG. 11 is plan view of the halves of the propeller guard in partially open positions.
Figure 8:
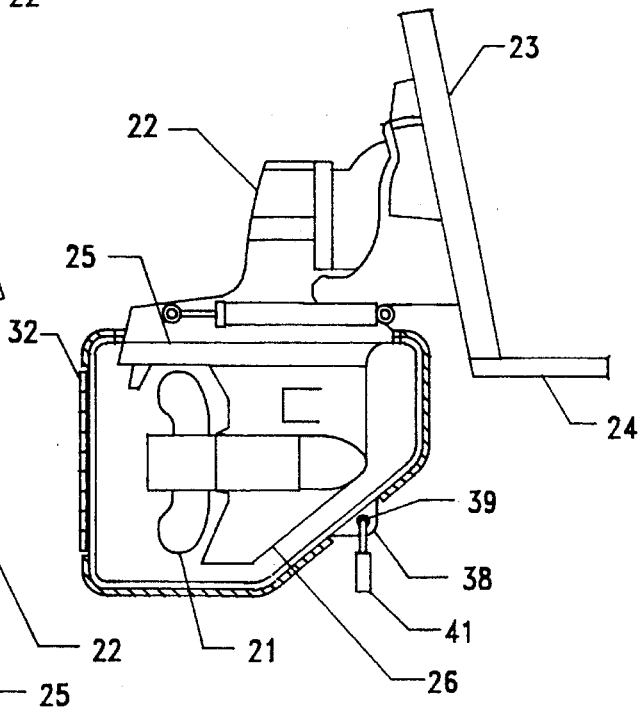
FIG. 8 is a cross-sectional view taken on the line 8—8 in FIG. 1.
Figure 12:
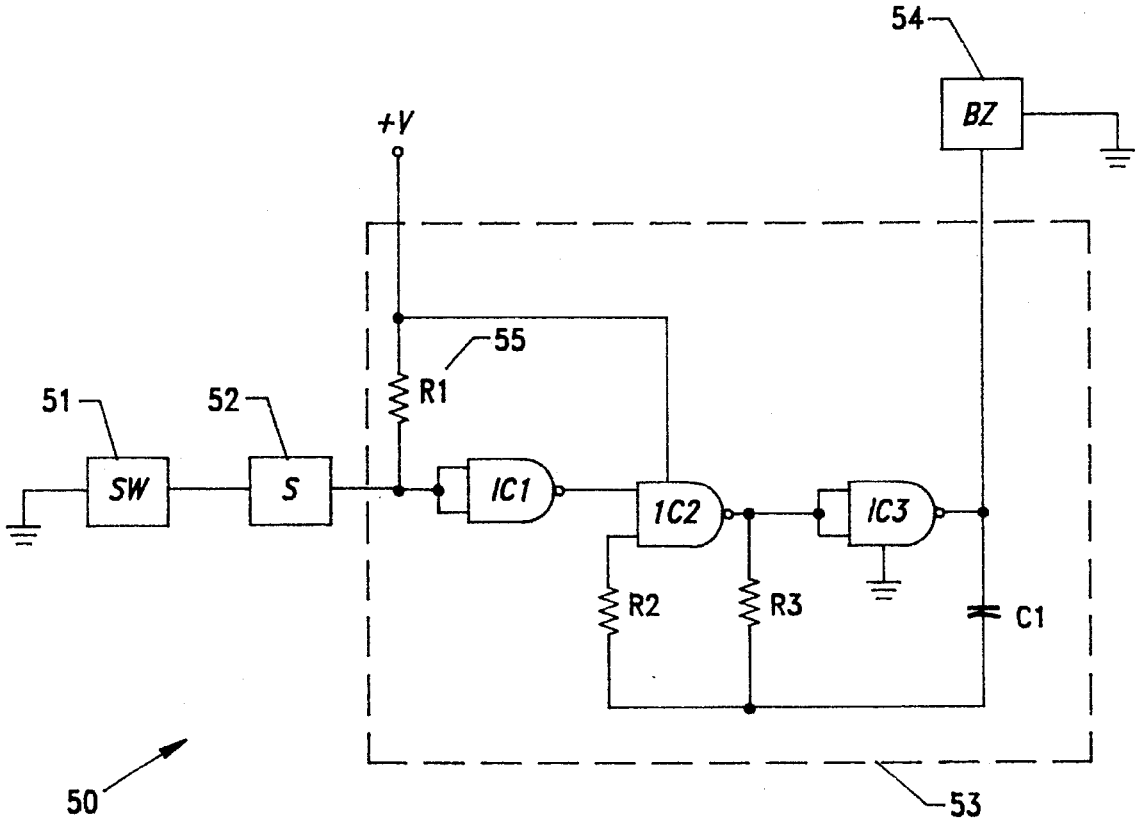
FIG. 12 is a schematic diagram of an electronic alarm system.
Figure 13:
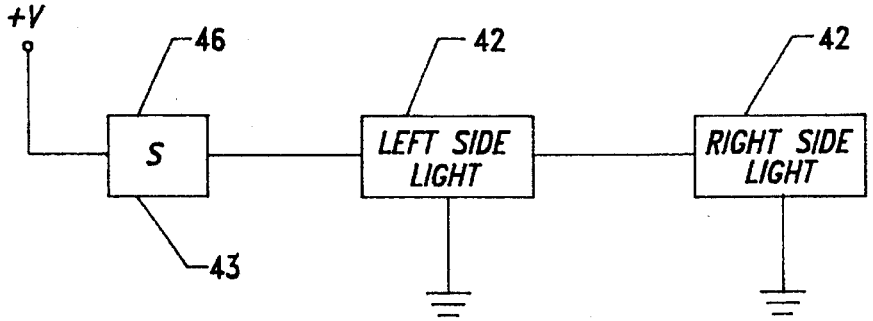
FIG. 13 is a schematic diagram of a lighting circuit.

The construction of the case 29 and lock 41 is best understood by referring first to FIGS. 2, 7 and 11. The case 29 is divided into right 30 and left 31 members which are pivotally connected with a metal hinge 32. Each member 30,31 has a top wall 33, a side wall 34, a front wall 35, a rear wall 36 and a bottom wall 37.

The case members 30,31 are preferably molded from a tough polymer material such as glass filled polyester, having sufficient strength and thickness to protect the propeller 21 from damage due to impact and to deter thieves from breaching the case 29 and removing the propeller 21.

Figure 4:
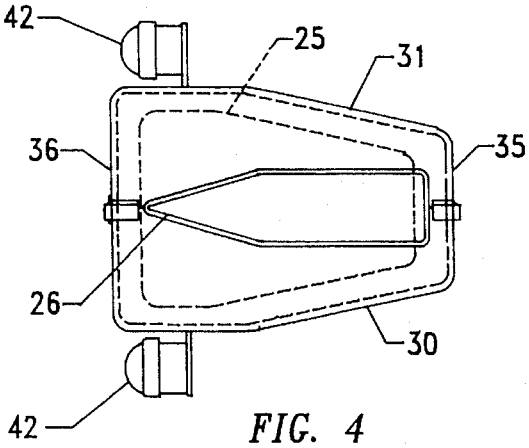
FIG. 4 is a cross-sectional view taken on the line 4—4 in FIG. 2, showing a plan view of the propeller guard and lock.
Figure 3:
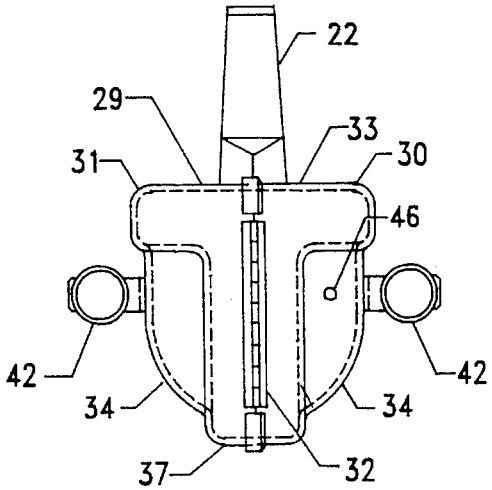
FIG. 3 is a rear view of the propeller guard and lock.
Figure 6:
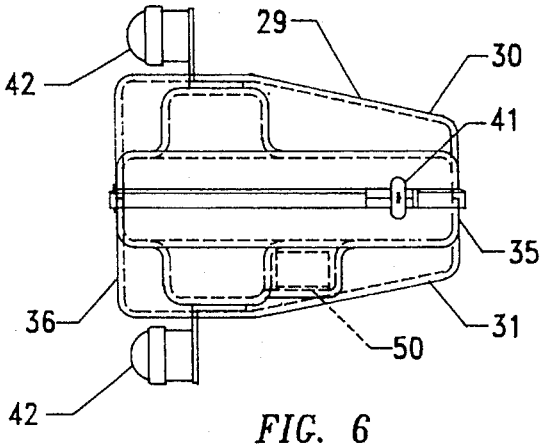
FIG. 6 is a bottom view of the propeller guard and lock.

Referring now to FIG. 4, the top walls 33 of the case members 30,31 are contoured to clear the propeller drive unit 22. The top walls 33 are supported by the stabilizer fin 25. It will be observed that the case 29 encloses the stabilizer fin 25 and rudder 26 as well as the propeller 21.

Extending forward from the front wall 35 of each case member 30,31 is an integral boss 38. Each boss 38 has an aperture 39 which receives a hasp 40 of the padlock 41. The padlock 41 lockably connects the case members 30,31. It will be appreciated that in lieu of the padlock 41, a conventional cylinder lock can be installed in the case members 30,31.

Figure 1:
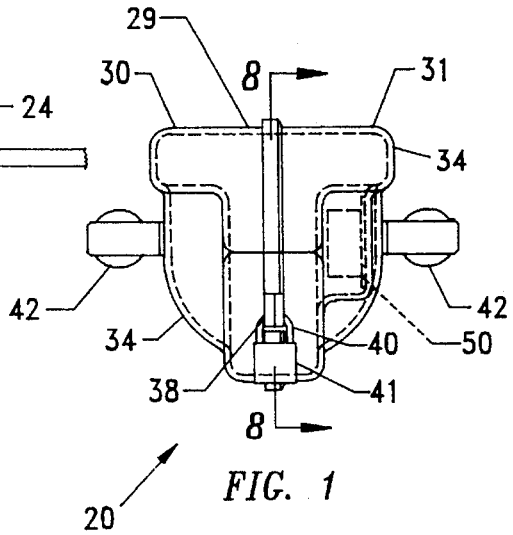
FIG. 1 is a front view of a boat propeller guard and lock according to the present invention.

Referring to FIGS. 1, 2 and 11, on a side wall 34 of each case member 30,31 is mounted a running light 42 for reducing the likelihood of an impact with another vehicle during reduced visibility or nighttime hours. The running lights 42 are connected in parallel to a switch 46 and a power source 43, such as a usual vehicle power supply or dry cell battery. At the bottom of the case members 30,31 are apertures 44 for draining water from the interior of the case 29.

Figure 5:
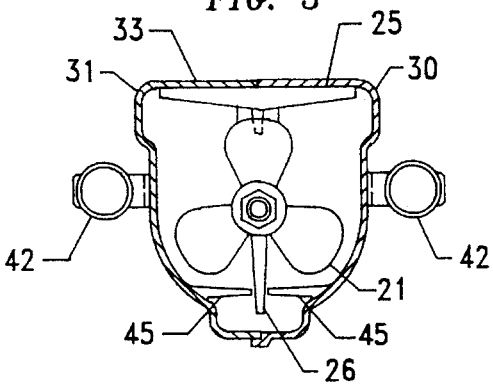
FIG. 5 is a cross-sectional view taken on the line 5—5 in FIG. 2.
Figure 9:
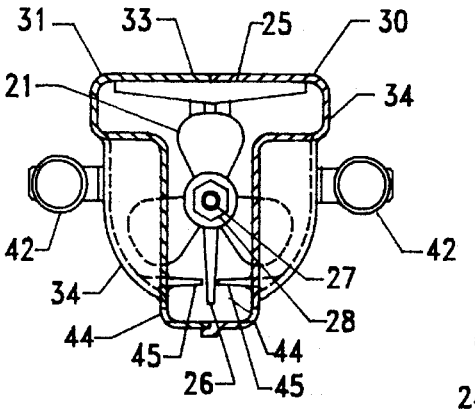
FIG. 9 is a cross-sectional view taken on the line 9—9 in FIG. 2.

With reference to FIGS. 2 and 5, in the interior of the case 29 a rib 45 extends inwardly from case member 30,31 to the vertical rudder 26. The ribs 45 prevent rotation of the case 29 on the propeller drive unit 22.

Figure 10:
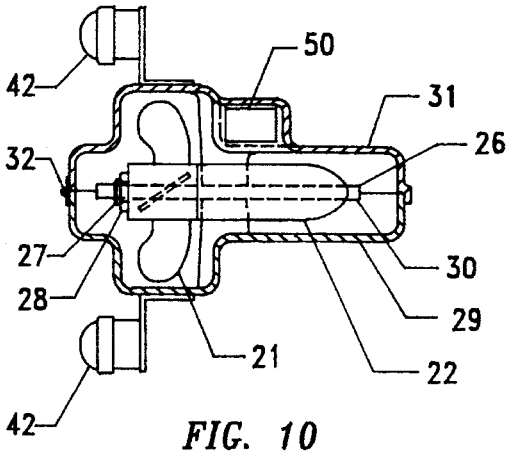
FIG. 10 is a cross-sectional view taken on the line 10—10 in FIG. 2.

Referring now to FIGS. 7 and 10, in the left member 31 of case 29 is an electronic burglar alarm 50. The burglar alarm 50 comprises a normally open key switch 51, a normally open sensor 52, a gated digital oscillator 53 and a buzzer 54. A normally open sensor 52 is preferred because if wiring is cut when the alarm 50 is armed, the alarm 50 is activated.

The alarm 50 is armed by closing the key switch 51. When the key switch 51 is closed, the key switch 51 forces the trigger input low, disabling the oscillator 53 and buzzer 54. When the case 29 is opened or disturbed, the sensor 52 closes, causing resistor 55 to pull the trigger input high, enabling the oscillator 53 and buzzer 54.

The manner of using the invention can be understood by reference to FIG. 11. To install the case 29, the lock 41 is removed, the case 29 is opened by pivoting members 30,31 and the case 29 is positioned on the propeller drive unit 22 with the top walls 33 of the case members 30,31 resting on the upper surface of the horizontal stabilizer 25. The case 29 is then closed and the lock 41 installed to lock the members 30,31 together.

From the foregoing, it will be apparent that the subject invention provides an improved guard and lock for deterring thieves and reducing damage to boat propellers.

Although but a single embodiment of my invention has been illustrated and described, it is not my intention to limit my invention to this embodiment since other embodiments can be developed by substitutions, rearrangment of parts and changes known to persons skilled in the art without departing from the spirit thereof.

I claim:

1. In an apparatus for reducing damage to and deterring theft of a boat propeller, comprising: a case for substantially enclosing a boat propeller and a portion of a drive unit to which said propeller is connected, said drive unit attached to a boat and including a horizontal stabilizer fin and a vertical rudder below said stabilizer fin, said case being divided approximately into symmetrically opposite members comprising a first member and a second member, said members having horizontal upper walls for supporting said case in an elevated position on said drive unit and being pivotally connected along a vertical axis for opening and closing said case to completely enclose said propeller and said stabilizer fin and rudder of said drive unit; a means for pivotally connecting said members; and a lock for selectively locking and unlocking said case members to prevent a theft of said propeller.

2. The apparatus case recited in claim 1 further comprising at least one light mounted on an external rear surface of said case for reducing the likelihood of impact of said drive unit with a vehicle during nighttime hours.

3. The apparatus case recited in claim 1 further comprising an electronic burglar alarm mounted in the interior of said case for preventing theft of said propeller, said alarm comprised of a normally open key switch for arming said alarm, a normally open sensor, a gated digital oscillator and a buzzer.

4. In an apparatus for reducing damage to and deterring theft of a boat propeller, comprising: a case for substantially enclosing a boat propeller and a portion of a drive unit to which said propeller is connected, said portion of said drive unit including a horizontal stabilizer fin and a vertical rudder; said case having a first member and a second member, said members being supported on said stabilizer fin and pivotally connected to each other for opening and closing said case to substantially enclose said propeller and said portion of said drive unit, including said stabilizer fin and said rudder, and at least one aperture in one of said case members for draining said case; a means for pivotally connecting said members; a means for selectively locking and unlocking said members to deter theft of said propeller; and an electronic burglar alarm mounted in the interior of said case for preventing theft of said propeller, said alarm having a gated digital oscillator and a buzzer.

5. The apparatus recited in claim 4 further comprising a light mounted on an external surface of each of said case members for reducing the likelihood of impact of said drive unit with a vehicle during nighttime hours.

6. The apparatus recited in claim 4 further comprising a means which is integral with said case for preventing rotation of said case when said case is mounted on said propeller drive unit, said means comprising a rib extending inwardly from each of said members toward said rudder.

7. In combination, an apparatus for reducing damage to and deterring theft of a boat propeller and a boat engine suspended from a boat, a case for substantially enclosing a boat propeller and a portion of a drive unit of said boat engine, said portion of said drive unit including a horizontal stabilizer fin and a vertical rudder, said case having a first member and a second member, said members being pivotally connected for opening and closing said case to substantially enclose said propeller and said portion of said drive unit in said case, including said stabilzer fin and said rudder, each of said members of said case having an upper wall, a side wall, a front wall, a rear wall, and a bottom wall, said upper walls being contoured to clear said portion of said drive unit when said upper wall is supported on said stabilizer fin of said drive unit, and at least one aperture in one of said case members for draining the interior of said case; a means for pivotally connecting said case members; a means which is integral with said case for preventing rotation of said case when said case is mounted on said propeller drive unit, said means comprising a rib extending inwardly from each of said side wails of said case members toward said rudder; and a means for selectively locking and unlocking said case to prevent a theft of said propeller.

8. The apparatus recited in claim 7 wherein said means for selectively locking said case members comprises a padlock.

9. The apparatus recited in claim 7 further comprising a light mounted on an external surface of each of said case members and a burglar alarm mounted in the interior of said case to deter theft of said propeller, said alarm comprised of a normally open switch for arming said alarm, a normally open sensor, a gated digital oscillator and a buzzer.

10. The apparatus recited in claim 7 wherein said case members are molded from a polymer such as glass filled polyester, having sufficient strength and thickness to protect said propeller from damage due to impact and to deter thieves from removing said propeller from said propeller drive unit.

* * * * *